US005896002A

United States Patent [19]

Van De Plas

[11] Patent Number: 5,896,002

[45] Date of Patent: Apr. 20, 1999

[54] COLOR DISPLAY TUBE HAVING AN ELECTRON GUN WITH FLASHOVER INHIBITING SUPPORT STRUCTURE

[75] Inventor: Johannes O. C. M. Van De Plas, Eindhoven, Netherlands

[73] Assignee: U.S. Philips Corporation, New York, N.Y.

[21] Appl. No.: 08/977,563

[22] Filed: Nov. 25, 1997

Related U.S. Application Data

[63] Continuation of application No. 08/025,298, Mar. 2, 1993.

[30] Foreign Application Priority Data

Mar. 27, 1992 [EP] European Pat. Off. ..... 92200873

[51] Int. Cl.[6] ..... H01J 29/50; H01J 29/04

[52] U.S. Cl. ..... 313/477 HC; 313/482; 313/417; 313/318.06

[58] Field of Search ..... 313/477 HC, 417, 313/318, 318.05, 318.06, 318.12; 335/210

[56] References Cited

U.S. PATENT DOCUMENTS

| | | | |
|---|---|---|---|
| 3,623,135 | 11/1971 | Doggett | 313/417 |
| 3,816,789 | 6/1974 | Sawagata et al. | 313/417 |
| 4,050,041 | 9/1977 | Schiecke | 335/210 |
| 4,082,977 | 4/1978 | Blumenberg | 313/457 |
| 4,484,102 | 11/1984 | Hale | 313/417 |
| 4,609,848 | 9/1986 | Takenobu | 313/457 |
| 4,853,584 | 8/1989 | Inoue | 313/417 |
| 4,855,639 | 8/1989 | Van Eck | 313/417 |
| 4,931,691 | 6/1990 | Hale | 313/417 |
| 4,992,698 | 2/1991 | Lundvall, II | 313/457 |
| 5,150,002 | 9/1992 | Van der Hoeck et al. | 313/417 |

*Primary Examiner*—Sandra O'Shea
*Assistant Examiner*—Matthew J. Gerike
*Attorney, Agent, or Firm*—Robert J. Kraus

[57] ABSTRACT

A color display tube having an in-line electron gun. The in-line electron gun has two elongated supporting elements and is secured to the electrical leadthroughs in the neck by two pairs of supports. The distance between the supports is at least 3 mm. By virtue thereof, one or more supports can be connected to a high-voltage leadthrough without the risk of flashover between the supports.

10 Claims, 3 Drawing Sheets

COLOR DISPLAY TUBE HAVING AN ELECTRON GUN WITH FLASHOVER INHIBITING SUPPORT STRUCTURE

This is a continuation of application Ser. No. 08/025,298, filed Mar. 2, 1993.

BACKGROUND OF THE INVENTION

The invention relates to a color display tube comprising a neck having a base with a number of electrical leadthroughs, and an in-line electron gun being arranged in said neck, said electron gun comprising electrodes which are interconnected by two supporting elements of insulating material which extend on either side of and approximately parallel to the in-line plane, and comprising a number of supports which each form a connection between a supporting element and an electrical leadthrough and electrically contact the respective electrical leadthrough.

Such a color display tube is of the customary type, which is also referred to as the "in-line" type. In operation, an in-line electron gun generates three electron beams which extend in one plane, the so-called in-line plane. The elongated supporting elements are generally made from glass and are also referred to as "multiform" rods. In the manufacture of the color display tube, electrical leadthroughs are formed in a supporting plate (the assembly of supporting plate and electrical leadthroughs is also termed "base plate"), the electron gun is manufactured, the supports are secured to leadthroughs, so that the electron gun and the base plate are interconnected, and the electron gun is slid into the neck. Subsequently, the base plate is secured to the neck. The base plate which has been secured to the neck will hereinafter also be referred to as the base.

Ever higher demands are imposed on the positional accuracy of the electron gun in the neck of the colour display tube. A displacement or rotation of the electron gun relative to a mean position is disadvantageous. It has been found that, during sliding the electron gun into the neck, a displacement and/or rotation of the electron gun, and hence of the in-line plane, may occur. Said displacement and/or rotation causes a variation in the position of the electron gun, i.e. deviations in the position of the electron gun relative to the mean position occur.

SUMMARY OF THE INVENTION

It is an object of the invention to provide a colour display tube of the type mentioned in the opening paragraph, having less variation in the position of the electron gun.

To this end, a colour display tube in accordance with the invention is characterized in that a pair of supports are connected to each supporting element, the individual supports of each pair are secured to different leadthroughs and the smallest distance between two supports connected to the same supporting element is at least 3 mm.

The electron gun customarily comprises three supports. Two of these supports are connected to one of the two supporting elements. The other support is connected to the other supporting element. While inserting such an electron gun in the neck, rotation of the electron gun occurs relatively frequently. The invention is inter alia based on the insight that an electron gun which comprises four supports has a higher mechanical rigidity and a smaller tendency to rotate during the insertion of the electron gun. This results in less variation in the position of the electron gun.

The invention is also based on a further insight:

In known electron guns the distance between two supports connected to one supporting element is approximately 1 mm. In operation, and in particular during sparking, high voltages (up to approximately 60 kV) are applied to some of the leadthroughs (hereinafter also referred to as "high-voltage leadthroughs"). Within the scope of the invention it has been found that if the minimum distance between two supports is less than approximately 3 mm and one of the supports is connected to a high-voltage leadthrough, flashover between these supports is likely to occur. Flashover may cause damage to the electron gun. By virtue of the invention, each of the four supports can be secured to the most suitable electrical leadthrough for the relevant support. By virtue thereof, a mechanically very rigid construction can be obtained in which the degree of variation is reduced.

In an embodiment each supporting element has a recessed portion between the supports connected to the relevant supporting element.

By virtue thereof, the risk of flashover between the supports is further reduced.

Preferably, the minimum distance between a support and an electrode is more than 3 mm.

Flashover between a support and an electrode of the electron gun may occur during sparking. When the minimum distance is more than 3 mm, the risk that flashover occurs is very small.

BRIEF DESCRIPTION OF THE DRAWING

The above-mentioned aspects and other aspects of the invention are described, by way of example, in greater detail with reference to the accompanying drawing, in which.

DESCRIPTION OF THE PREFERRED EMBODIMENT

Figure 1:
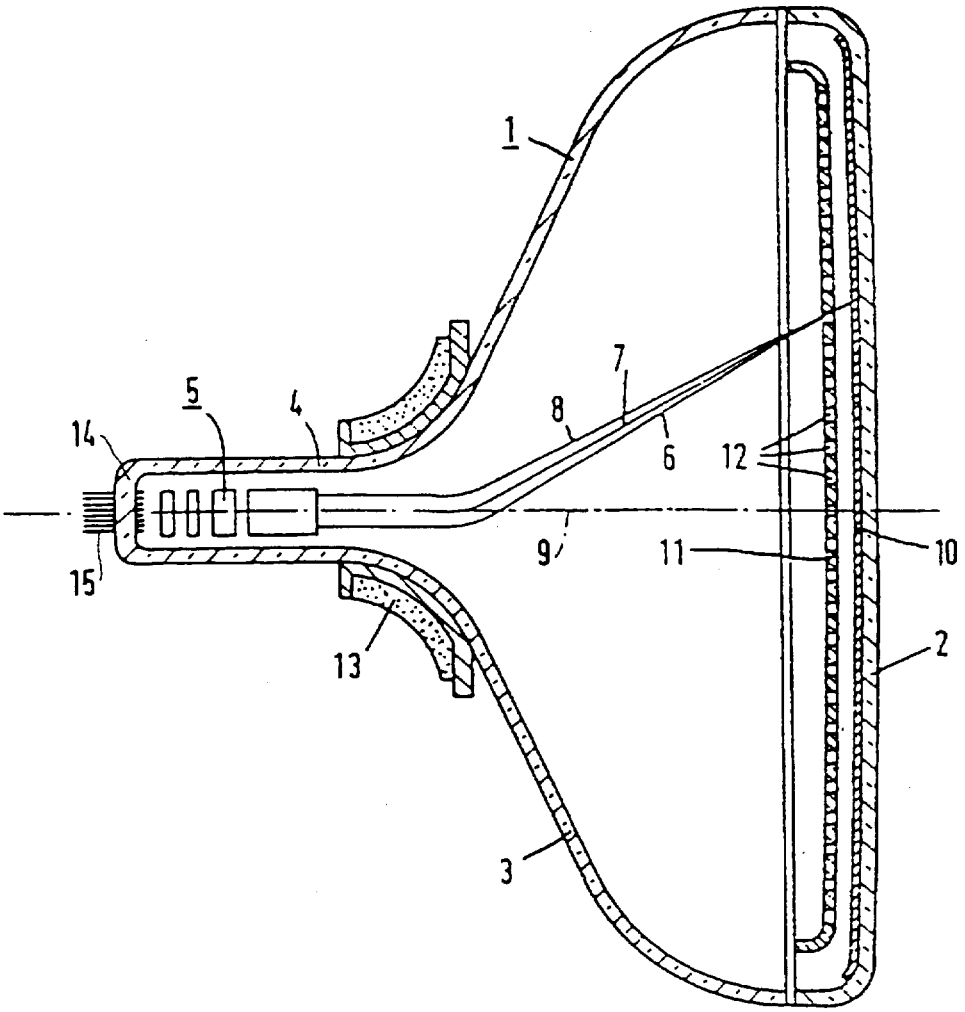
FIG. 1 is a sectional view of a colour display tube in accordance with the invention.

The Figures are diagrammatic and not drawn to scale; in the various embodiments, corresponding parts generally bear the same reference numerals.

FIG. 1 is a sectional view of an embodiment of a colour display tube in accordance with the invention. Said colour display tube has a glass envelope 1 which comprises a display window 2, a cone 3 and a neck 4. In the neck 4 there is arranged an electron gun 5 for generating three electron beams 6, 7 and 8 which extend in one plane, the so-called in-line plane. In the undeflected state, the axis of electron beam 7 coincides with the axis 9 of the colour display tube.

On the inside of a display screen 10, the display window is provided with a large number of triads of phosphor elements. The phosphor elements may be in the form of, for example, lines or dots. In the present example, the display window is provided with linear elements. Each triad comprises a line with a phosphor luminescing in green, a line with a phosphor luminescing in red, and a line with a phosphor luminescing in blue. In this example, the phosphor lines extend perpendicularly to the plane of the drawing. A shadow mask 11 having a large number of apertures 12 is positioned in front of the display screen 10. The electron beams 6, 7 and 8 are deflected by deflection coil system 13. The neck 4 is provided with a base 14 having electrical leadthroughs 15.

Figure 2:
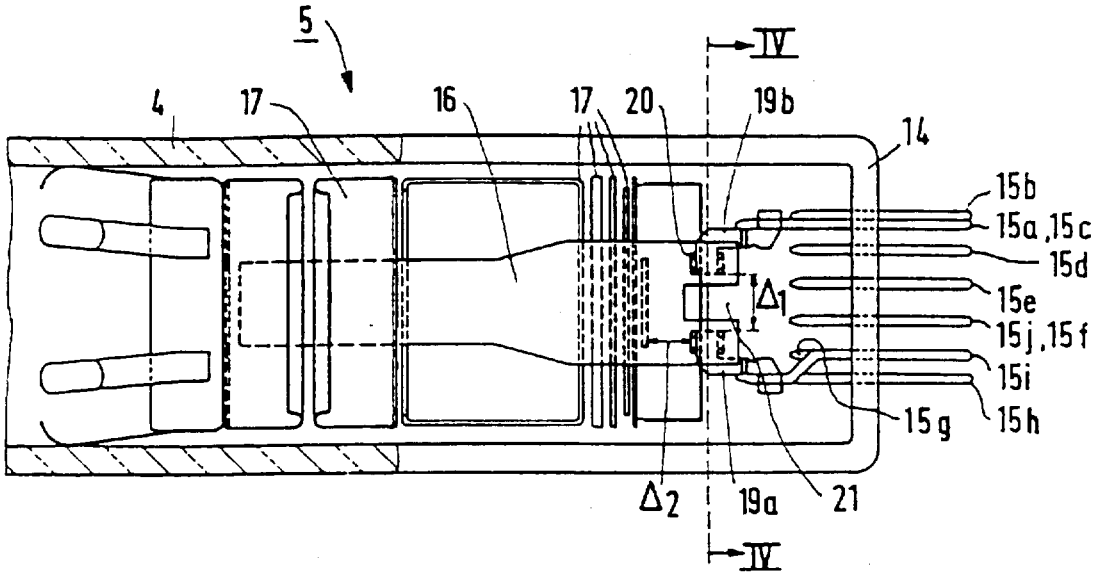
FIG. 2 is a partly sectional view taken on the in-line plane and a partly elevational view of the neck including the electron gun, the base and leadthroughs.
Figure 3:
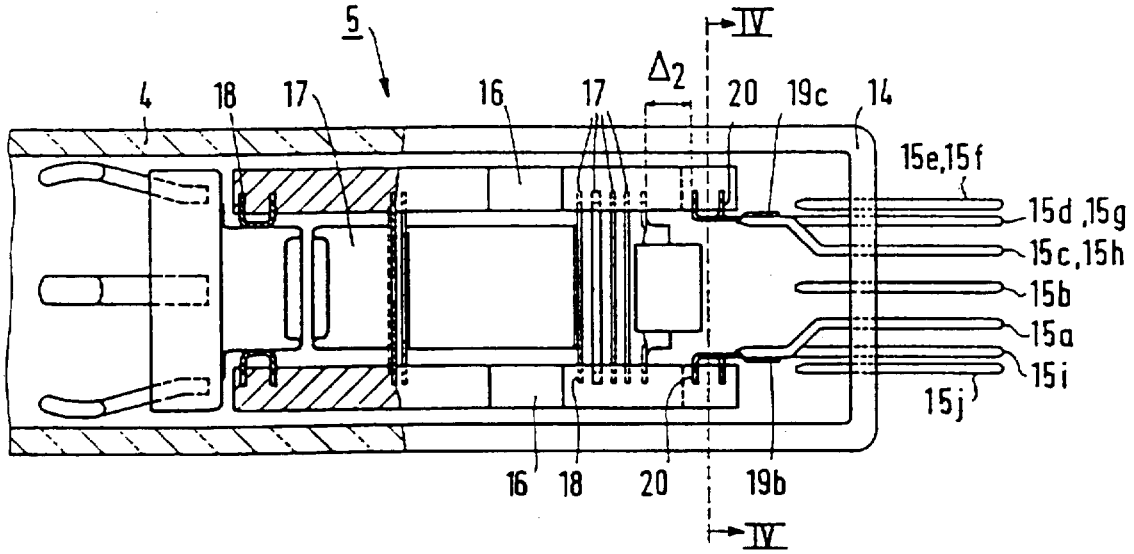
FIG. 3 is a partly sectional view taken on a plane which extends transversely to the in-line plane and a partly elevational view of the neck including the electron gun, the base and leadthroughs.
Figure 4:
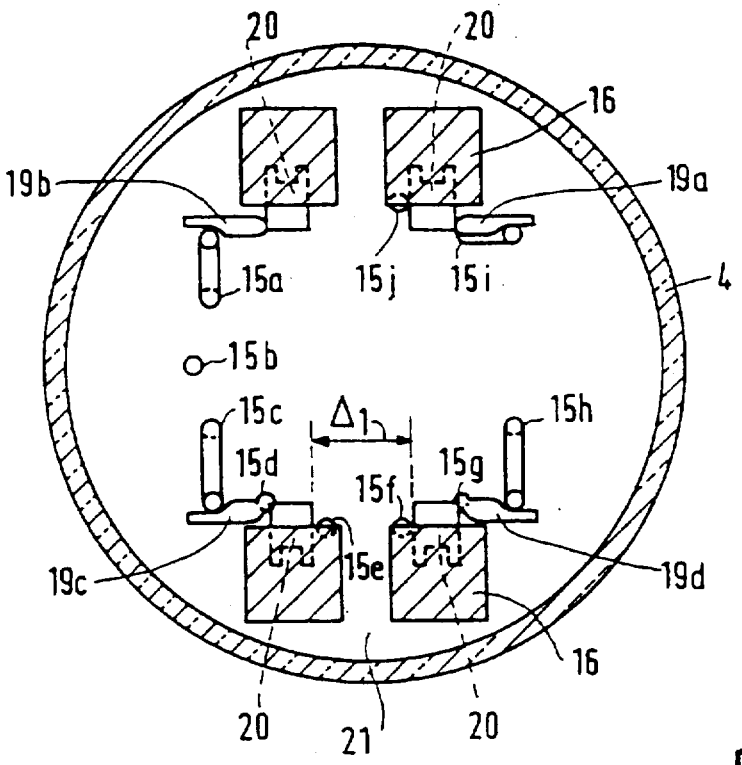
FIG. 4 is a partly sectional view taken on the plane IV—IV in FIG. 3 and a partly elevational view of the positions of supporting elements, supports and leadthroughs relative to each other.

FIG. 2 is a partly sectional view, taken on the in-line plane, and a partly elevational view of the electron gun 5 in neck 4. FIG. 3 is a partly sectional view, taken on a plane transversely to the in-line plane and through the tube axis, and a partly elevational view of the electron gun 5 in neck 4. The neck 4 comprises a base 14 having electrical leadthroughs 15*a* up to and including 15*j*. The electron gun 5 comprises a number of electrodes 17 and two supporting elements 16 which are made from insulating material. The supporting elements extend on either side of the in-line plane. The electrodes 17 have apertures to allow passage of the electron beam. The electrodes 17 have projecting portions 18 which are inserted into the supporting elements 16. The electrodes are interconnected by means of the supporting elements. Four supports 19*a* up to and including 19*d* are secured to the supporting elements 16. These supports are made from electrically conductive material, for example metal. Each support has projecting portions 20 which are inserted into a supporting element. The four supports 19*a* up to and including 19*d* are secured to four leadthroughs (15*i*, 15*a*, 15*c* and 15*h*, respectively) which approximately form a quadrangle. In the customary construction the electron gun was secured to the leadthroughs by means of three supports. In the manufacture of the colour display tube, the electron gun is secured to the leadthroughs and hence to the base, via the supports. The electron gun is then slid into the neck and the base is secured to the neck. During sliding-in of the electron gun, the electron gun is subjected to forces which may bring about a rotation of the electron gun. Such rotation causes the position of the in-line plane to be unsteady, which adversely affects picture display. In the known construction the mean value of the rotation caused by sliding the electron gun into the neck customarily amounts to approximately 0.75°. In a colour display tube in accordance with the invention the rotation caused by sliding-in of the electron gun is negligibly small. Consequently, the variation in the position of the electron gun is reduced.

Figure 6:
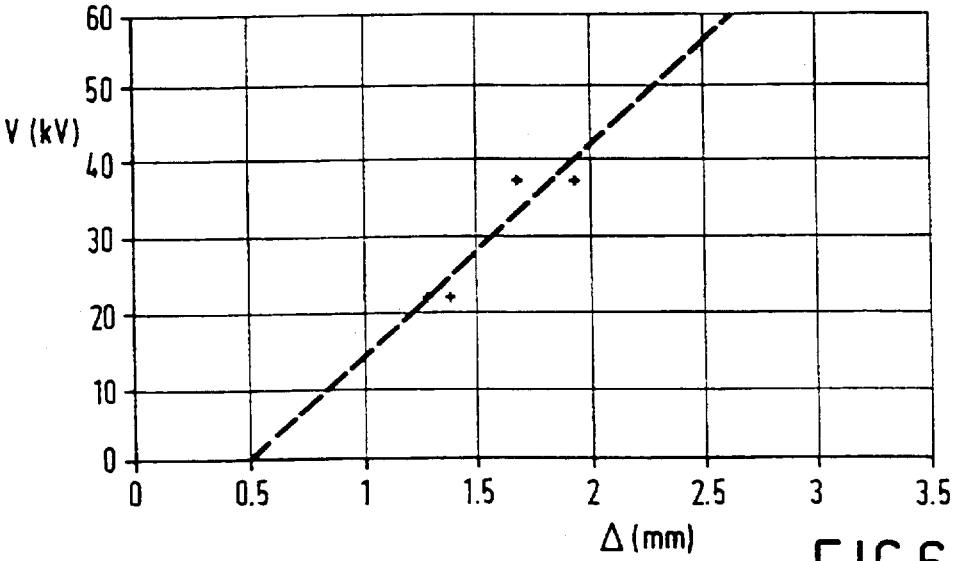
FIG. 6 graphically shows the relation between the distance between the supports and the voltage at which flashover occurs.
Figure 5:
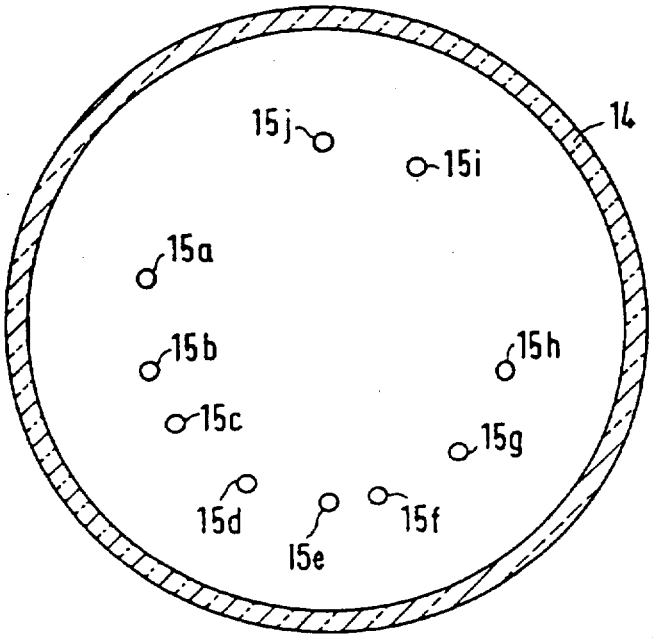
FIG. 5 shows the relative positions of the leadthroughs in the base.

During operation or during the manufacture of the colour display tube, some of the leadthroughs are used for carrying high voltages. In the example shown, high voltages are applied to the leadthroughs 15*i* and 15*j* during the sparking of the electron gun. Sparking an electron gun is a customary process step in the manufacture of certain types of colour display tubes, in which process step a very high (up to approximately 60 kV) voltage is applied to a number of electrodes. This causes sparks to jump the gap between electrodes, thereby removing burrs and irregularities. Methods of sparking an electron gun are described in, inter alia, European Patent Application EP 0195485. FIG. 5 shows the relative positions of the leadthroughs 15*a* up to and including 15*j* in the base. During operation and during the manufacture of the colour display tube relatively low voltages (up to approximately 5 kV) are applied to the leadthroughs 15*a* up to and including 15*h*. In general, the position of the leadthroughs cannot be arbitrarily selected, because it must comply with the international standards. In operation, relatively high voltages (40–60 kV) are applied to the leadthroughs 15*i* and 15*j*, in particular during the sparking of the electron gun. FIG. 6 shows, as a function of the distance between two supports arranged next to one another in a supporting element (Δ in mm), the voltage difference between such supports (V in kV) at which sparking between the supports occurs. The crosses indicate measuring points, the dotted line is an approximation of the relation Δ-V. The graph shows that at a value of Δ in excess of approximately 3 mm no sparking occurs for values below approximately 60 kV. Consequently, if the minimum distance between the supports 19 is more than approximately 3 mm the supports can be connected to the most suitable leadthroughs without the occurrence of sparking. In this example, support 19*a* is connected to leadthrough 15*i*. The leadthroughs 15*a*, 15*c*, 15*h* and 15*i*, to which the supports are secured, form a quadrangle whose centre roughly coincides with the tube axis. If support 19*a* could not be connected to support 15*j* or 15*i* but instead had to be connected to one of the supports 15*a* up to and including 15*h*, the construction would be less rigid and an, on average, greater rotation of the electron gun and hence a variation in the position of the electron gun would occur during the insertion process. In the example shown in FIGS. 2 and 3, the smallest distance between the supports 19*a* and 19*b* and between the supports 19*c* and 19*d* ($\Delta_1$) is 4.5 mm.

In this example the supporting elements are provided with recesses 21 between the supports 19*a* and 19*b* and between the supports 19*c* and 19*d*. A recess between the supports increases the distance between the supports, measured along the surface of the respective supporting element. By virtue thereof, the risk of sparking is reduced.

In this example the smallest distance between a support and an electrode is approximately 4.5 mm. Preferably, the smallest distance ($\Delta_2$) between a support and an electrode, which within the scope of the invention is measured along the surface of a supporting element, is larger than 3 mm. In this case, the risk that, during sparking or during operation, flashover occurs between a support and an electrode is very small.

It will be obvious that within the scope of the invention many variations are possible to those skilled in the art.

I claim:

1. A color display tube having an axis and comprising a neck having a base with a number of electrical leadthroughs, and an in-line electron gun supported in said neck, said electron gun comprising electrodes which are interconnected by two supporting elements of insulating material which extend on either side of and approximately parallel to the axis, and comprising a number of electrically conductive supports which each form a connection between a supporting element and an electrical leadthrough and electrically contact the respective electrical leadthrough, characterized in that a pair of supports are connected to each supporting element, the individual supports of each pair are secured to different ones of the leadthroughs and the smallest distance between two of the supports connected to the same supporting element is at least 3 mm, at least one of the supports being connected to a leadthrough to which a high voltage is to be applied.

2. A color display tube comprising a neck having a base including a plurality of electrical leadthroughs, and an electron gun supported in the neck on an axis of the tube for producing a plurality of electron beams centered substantially in a common plane, said electron gun comprising:

a. first and second supporting elements of insulating material extending along the neck on opposite sides of the axis;

b. a plurality of axially-separated electrodes secured between the first and second supporting elements;

c. first and second conductive supports attached to the first supporting element, each of said first and second supports being electrically connected to a respective one of the electrical leadthroughs and having a minimum separation from each other which is sufficient to prevent flashover at a predetermined operational potential difference between said first and second supports; and d. third and fourth conductive supports attached to the second supporting element, each of said third and fourth supports being electrically connected to a respective one of the electrical leadthroughs and having a minimum separation from each other which is sufficient to prevent flashover at a predetermined operational potential difference between said third and fourth supports;

at least one of the supports being connected to a leadthrough to which a high voltage is to be applied.

3. A color display tube as claimed in claim 1 or 2, characterized in that each supporting element has a recessed portion disposed between the supports connected to the respective supporting element.

4. A color display tube as claimed in claim 1 or 2, characterized in that the each support is spaced apart from the electrodes by a minimum distance, measured along the surface of a supporting element, greater than 3 mm.

5. A color display tube as claimed in claim 1 or 2 characterized in that the respective leadthroughs, to which the supports are secured, form a quadrangle having a center approximately corresponding with the axis.

6. A color display tube as in claim 5 where the first and second supporting elements are disposed on opposite sides of the plane.

7. A color display tube comprising a neck, an in-line electron gun disposed about an axis of the tube, and means for supporting the electron gun in the neck both during and after insertion into said neck;

said electron gun comprising:

a. first and second axially-extending, rod-shaped supporting elements of insulating material disposed on opposite sides of the axis;

b. a plurality of axially-arranged electrodes disposed between and supported on respective opposite sides by the rod-shaped supporting elements, each of said electrodes having a plurality of in-line apertures for passing respective electron beams;

said means for supporting the electron gun in the neck comprising:

c. a base plate for attachment to an end of the neck, said base plate having a plurality of electrical leadthroughs; and d. a pair of electrically conductive supports attached to each of the first and second supporting elements, proximate the base plate, each of said supports being secured to a respective one of the electrical leadthroughs.

8. A color display tube as in claim 7 where the respective leadthroughs, to which the supports are secured, define a quadrangle having a center approximately coinciding with the axis.

9. A color display tube as in claim 7 where the smallest distance between the supports in at least one of said pairs is sufficiently large to prevent flashover when a sparking high voltage is applied to said supports.

10. A color display tube as in claim 7 where at least one of the first and second supporting elements has a recessed portion disposed between the pair of attached supports.

* * * * *